US009510694B2

(12) United States Patent
Hozer et al.

(10) Patent No.: US 9,510,694 B2
(45) Date of Patent: Dec. 6, 2016

(54) CHILD CARRIER BUMPER ATTACHMENT

(71) Applicants: Jennifer Hozer, Moorpark, CA (US); Norm Hozer, Crandall, IN (US); Yvonne Gardner, Malibu, CA (US)

(72) Inventors: Jennifer Hozer, Moorpark, CA (US); Norm Hozer, Crandall, IN (US); Yvonne Gardner, Malibu, CA (US)

( * ) Notice: Subject to any disclaimer, the term of this patent is extended or adjusted under 35 U.S.C. 154(b) by 0 days.

(21) Appl. No.: 14/670,690

(22) Filed: Mar. 27, 2015

(65) Prior Publication Data

US 2015/0272344 A1 Oct. 1, 2015

Related U.S. Application Data

(60) Provisional application No. 61/970,984, filed on Mar. 27, 2014.

(51) Int. Cl.

| | |
|---|---|
| ***F16M 11/00*** | (2006.01) |
| ***A47D 15/00*** | (2006.01) |
| ***A47D 13/02*** | (2006.01) |

(52) U.S. Cl.

CPC ..... *A47D 15/00* (2013.01); *A47D 13/025* (2013.01)

(58) Field of Classification Search

CPC ..... A47D 15/00; A47D 13/02
USPC ..... 248/682; 297/183.1, 183.2, 183.3, 297/219.1, 219.12; 2/22
See application file for complete search history.

(56) References Cited

U.S. PATENT DOCUMENTS

| | | | | |
|---|---|---|---|---|
| 8,061,768 | B2 * | 11/2011 | Amirault | B60N 2/2851 297/216.11 |
| 9,051,029 | B2 * | 6/2015 | Hays, III | B63B 29/04 |
| 2012/0175920 | A1 * | 7/2012 | Carbone | A47D 13/02 297/183.1 |
| 2012/0267924 | A1 | 10/2012 | Chipman et al. | |

* cited by examiner

*Primary Examiner* — Todd M Epps
(74) *Attorney, Agent, or Firm* — Christina Chamberlain

(57) ABSTRACT

A bumper attachment for a child carrier generally comprised of a locking mechanism, a handle placement guide, a rigid body contour, and a layer of cushioning material. The locking mechanism locks the handle of a child carrier into the handle placement guide, thereby positioning the layer of cushioning material that abuts the rigid body contour against the body of the user.

20 Claims, 10 Drawing Sheets

CHILD CARRIER BUMPER ATTACHMENT

RELATED APPLICATIONS

This application claims priority to U.S. Provisional Application No. 61/970,984 filed Mar. 27, 2014. The entire contents of the above application are hereby incorporated by reference as though fully set forth herein.

FIELD

The present invention relates to child carriers and more specifically to an attachment for a child carrier intended to cushion the child carrier against the body of the user holding or transporting the child carrier.

BACKGROUND

In the prior art there are various carriers for safely transporting infants and small children. A traditional child carrier is in the form of a seat that is typically comprised of a plastic seat shell having a seat back for supporting the infant or child, a rotatable U-shaped lifting handle that extended laterally across the seat for lifting and carrying the seat, and a safety harness system and padding for the comfort of the infant or child placed in the seat.

One major flaw in the carrier design in the prior art is that a person cannot comfortably carry the carrier, as the seat of the carrier falls against the person's hip or leg when carrying the seat. Most carrier designs in the prior art incorporate padded sections on the seat shell or incorporate alternative carrying handles to attempt to meet this need. Some even provide a hip contour piece on the seat shell, such as that disclosed in US Publication No. 2012/0267924 to Chipman et. al. However, there still exists a need for an attachment that can be added to any carrier that moves with the body of the user, allows the user to comfortably distribute the weight of the carrier against the body of the user.

BRIEF SUMMARY OF THE INVENTION

The present invention is a bumper attachment for supporting the load of a child carrier on a person that creates a clearance or a padded area between the body of the user and the child carrier. The carrying device moves in tandem with the body of the user while walking. Traditionally, when a child carrier is rest against their body, it creates jostling movements that simultaneously transfer to the occupant of the carrier. This action causes the user to place the carrier away from their body to avoid excessive jostling to the occupant. The carrying device prevents the user from relying on awkward positioning to place the carrier away from their body to avoid jostling, as well as provides greater comfort to both the occupant of the carrier and the user.

In the preferred embodiment of the present invention, the bumper attachment is generally comprised of a locking mechanism, a handle placement guide, a rigid body contour, and a layer of cushioning material. The locking mechanism locks the handle of a child carrier into the handle placement guide, thereby positioning the layer of cushioning material that abuts the rigid body contour against the body of the user.

DETAILED DESCRIPTION

Figure 1:
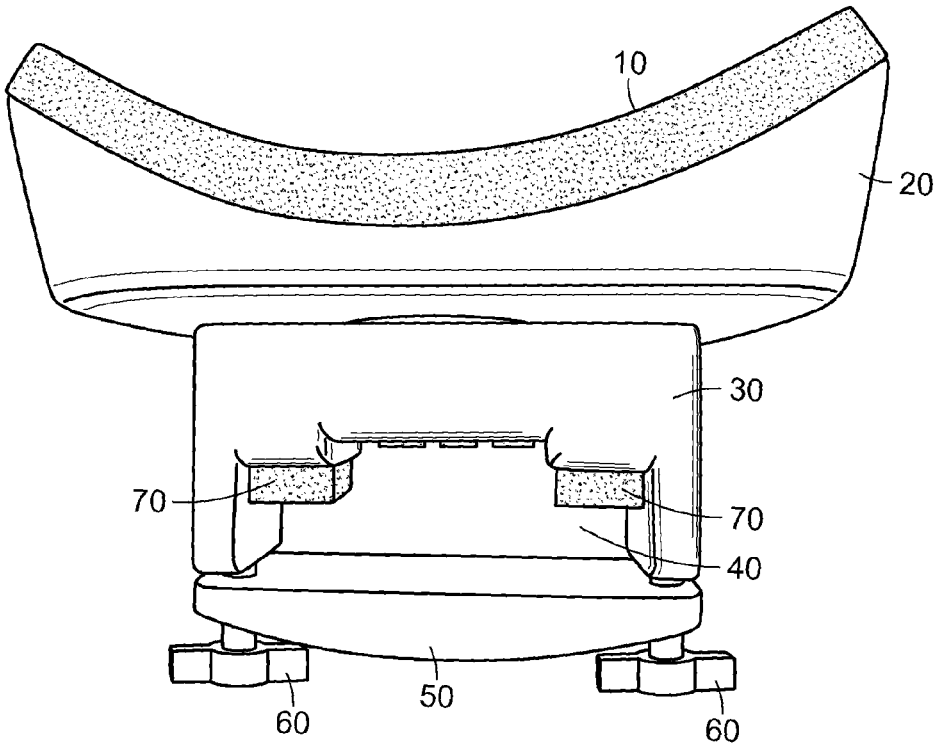
FIG. 1 is a side view of one embodiment of the present invention.

As shown generally in FIGS. 1-4, one embodiment of the present invention shows a layer of cushioning material 10 that abuts a rigid body contour 20. The cushioning material 10 may be made from a foam material covered in a durable material such as PVC, Neoprene or other suitable cushioned material. The rigid body contour 20 is contoured such that the bumper attachment can rest comfortably against the body when in use, typically resting against a thigh or hip. The bumper attachment is held in place on a handle of a child carrier using a locking mechanism and a handle placement guide. The locking mechanism in the preferred embodiment of the present invention shown in detail in FIG. 1 comprises a plurality of screws 60 that are tightened into position using a washer and wing nut to secure the handle placement guide. The handle placement guide is comprised of base plate 50, upper plate 30 and guide hole 40. The base plate 50 and the upper plate 30 are locked together through holes that align on the base plate 50 and upper plate 30 using the screws 60 with corresponding washers and wing nuts after the handle has been placed through guide hole 40.

In the preferred embodiment, there are at least two locking mechanisms located on opposite sides of the base plate 50. However, it is understood that there are many different locking mechanisms that may be used to secure the base plate 50 and upper plate 30 such that the handle of the carrier passes through the guide hole 40.

The rigid body contour 20, base plate 50 and upper plate 30 may be manufactured using any suitable rigid plastic material, such as Thermoset plastics like polyurethanes, polyesters, PVC, epoxy resins and phenolic resins. In the preferred embodiment, the parts of the bumper attachment are made from an injection mold manufacturing process but are not limited to that process for manufacture.

Figure 2:
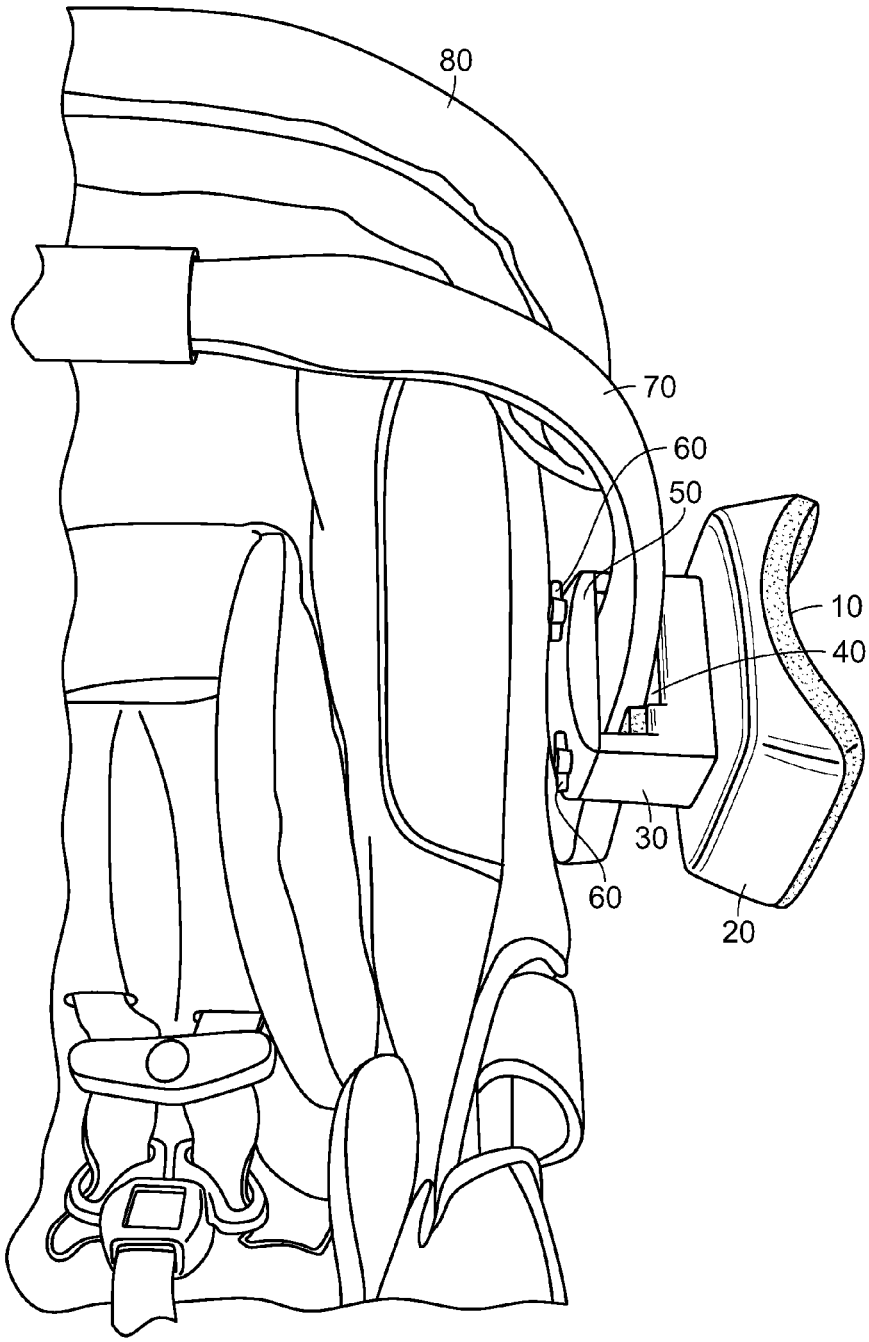
FIG. 2 is a perspective view of the embodiment of the present invention from FIG. 1 attached to the handle of a child carrier.
Figure 3:
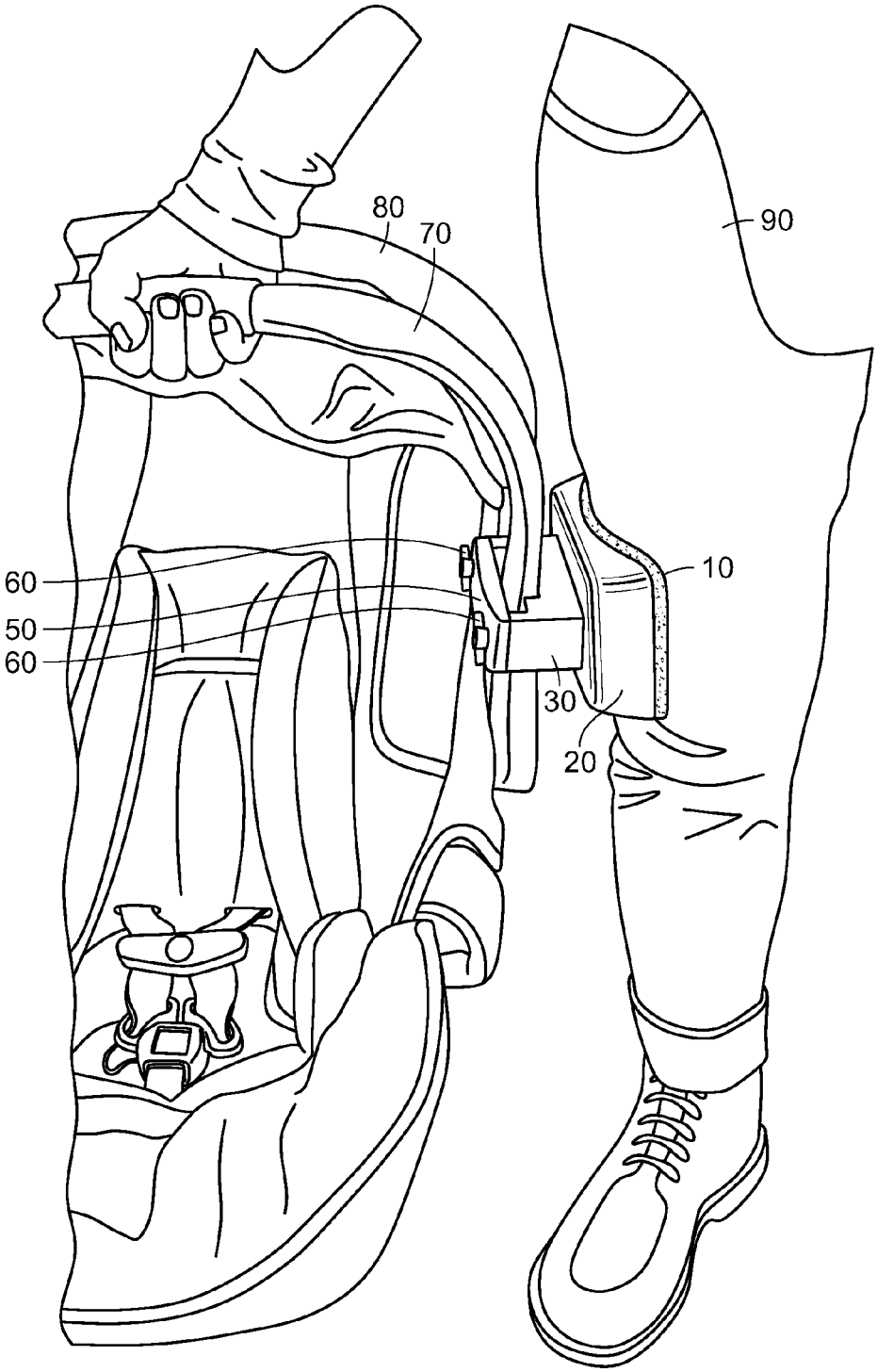
FIG. 3 is a perspective view of the embodiment of the present invention from FIG. 1 used as a cushion against the leg.

Turning to FIGS. 2-3, the child carrier body 80 and child carrier handle 70 are shown wherein the carrier handle 70 passes through the guide hole 40. The bumper attachment is secured into place around the carrier handle 70 using locking mechanisms 60, which attach base plate 50 and upper plate 30 to each other. The rigid body contour 20 supports the layer of cushioning material 10. The layer of cushioning material 10 contacts the user's leg 90 when in use, as shown in FIG. 3, or contacts the torso of the user's body 100 when in use, as shown in FIG. 4.

Turning to FIG. 3, the user grips the carrier handle 70 thereby resting the carrier 80 against the user's leg 90. The rigid body contour 20 supports the layer of cushioning 10 that rests directly against the user's leg 90.

Figure 4:
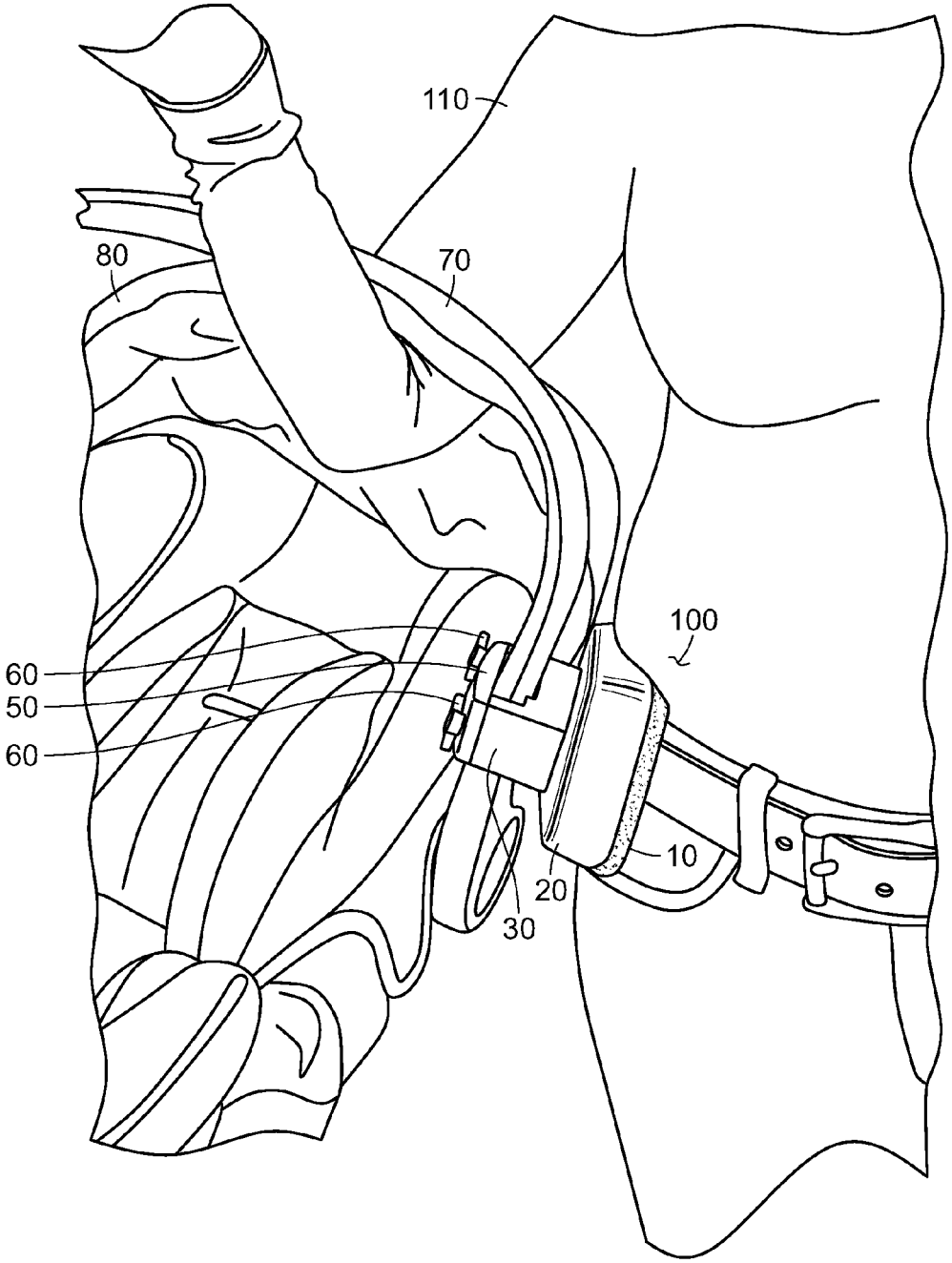
FIG. 4 is a perspective view of the embodiment of the present invention from FIG. 1 used as a cushion against the torso.

Turning to FIG. 4, an alternative way to hold the child carrier using the bumper attachment of the present invention is shown wherein the user holds the carrier handle 70 using the bend on their arm 110. The rigid body contour 20 supports the layer of cushioning material 10. The layer of cushion material 10 contacts the torso of the user's body 100 when in use.

Figure 5:
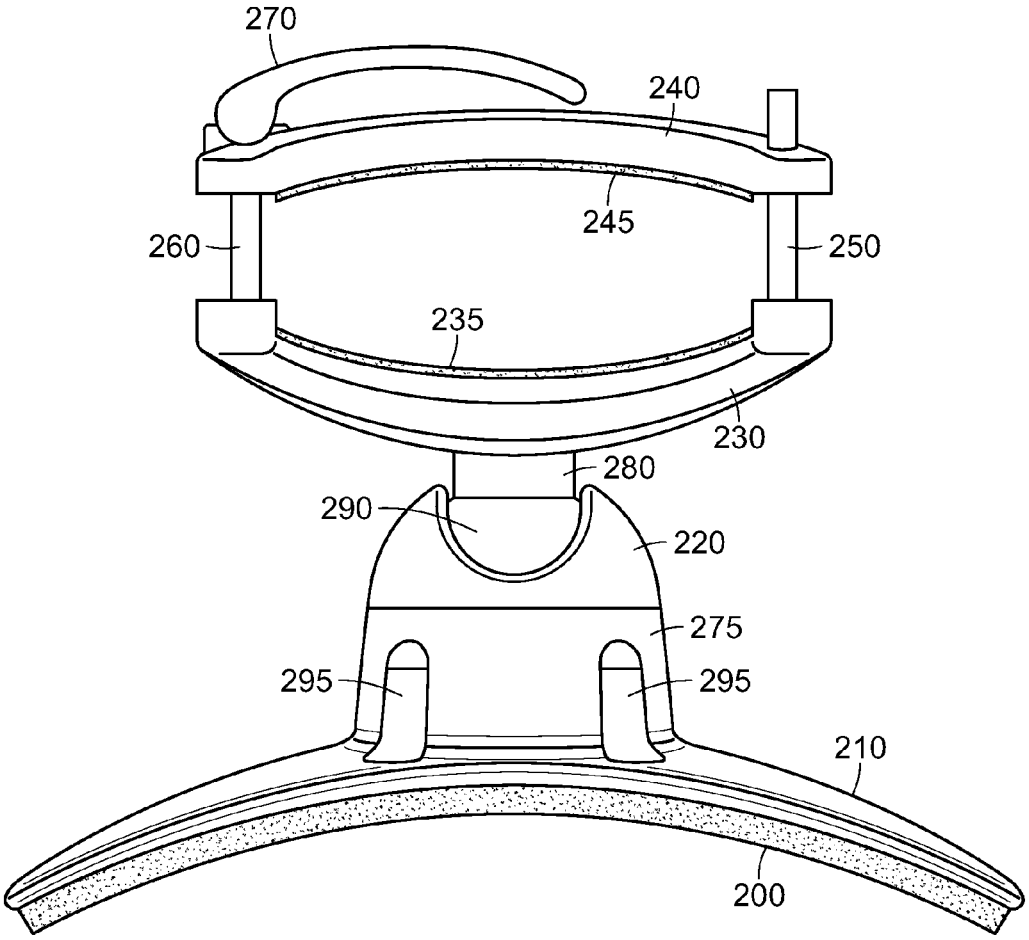
FIG. 5 is a side view of an alternative embodiment of the present invention.
Figure 6:
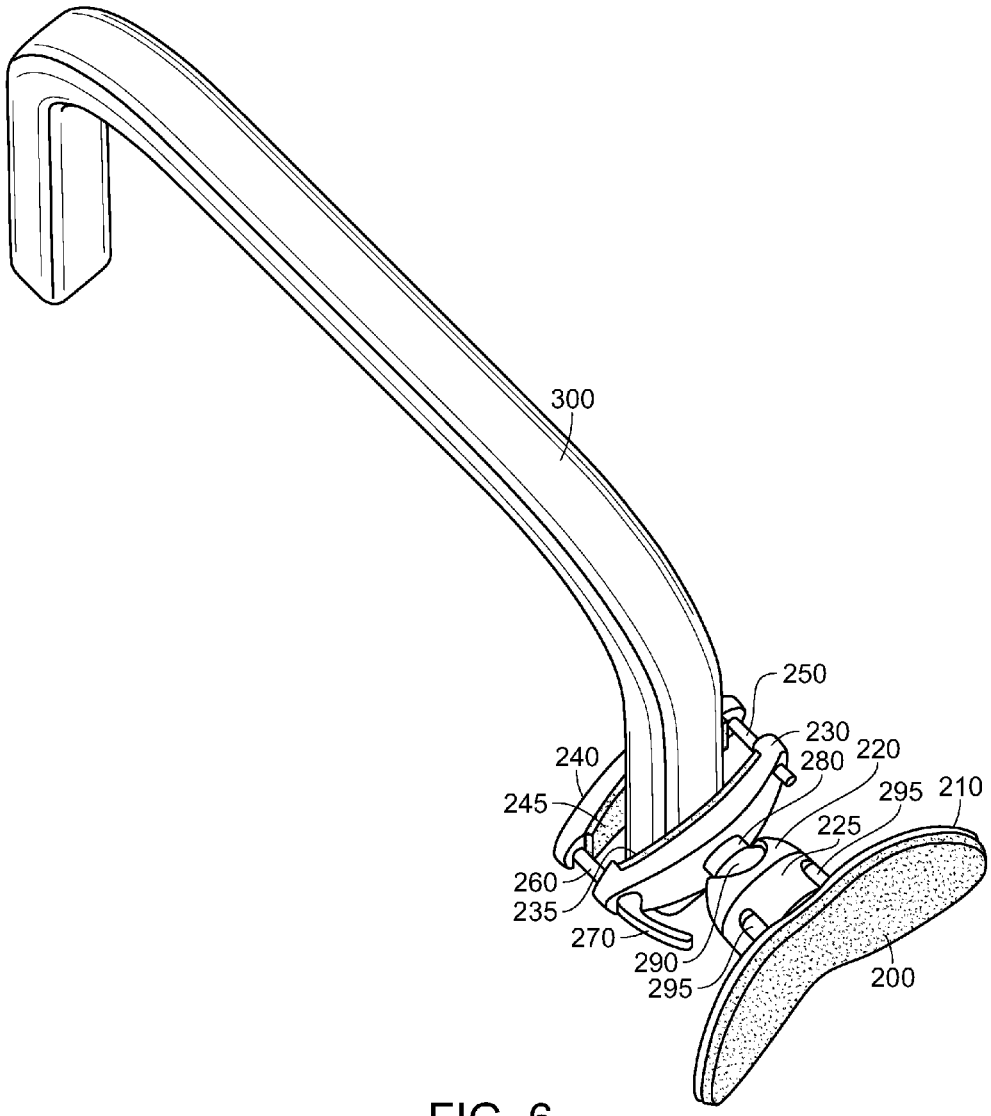
FIG. 6 is a perspective view of the alternative embodiment shown in FIG. 5 attached to the handle of a child carrier.

Turning to FIGS. 5 and 6, an alternative locking mechanism is shown wherein a clamp is designed to surround the carrier handle 300 by sandwiching the handle 300 between two opposing pieces 230 and 240 that clamp down or tighten around the handle 300 to keep the device in place and stable. A first half of the two-piece clamp 230 is attached to the rigid body contour 210 via a ball joint socket 280 and 290 into a base 220. The base 220 is attached to support piece 275, which is attached to the rigid body contour 210 via attachment points 295. A second half of the two-piece clamp closure 240 is attached to the first half 230 at one end with a self-tightening screw 250. The second half 240 is put into place by lining up vertically across from the first half 230 and aligns with another self-tightening screw 260 at the opposite end. A handle 270 is used to screw down or tighten screw 260 and the entire clamp around the carrier handle 300. Both halves of the clamp 230 and 240 tighten down simultaneously to lock the device into place. The clamp halves 230 and 240 may be lined with a layer of cushioning or gripping material 235 and 245, respectively. The clamp is designed to accommodate any thickness or width measurement of any infant carrier on the market.

The layer of cushioning material 200 abuts a rigid body contour 210. The cushioning material 200 may be made from a foam material covered in a durable material such as PVC, Neoprene or other suitable cushioned material. The rigid body contour 210 is contoured such that the bumper attachment can rest comfortably against the body when in use, typically resting against a thigh or hip. The bumper attachment is held in place on a handle of a child carrier using a locking mechanism and a handle placement guide.

Figure 8:
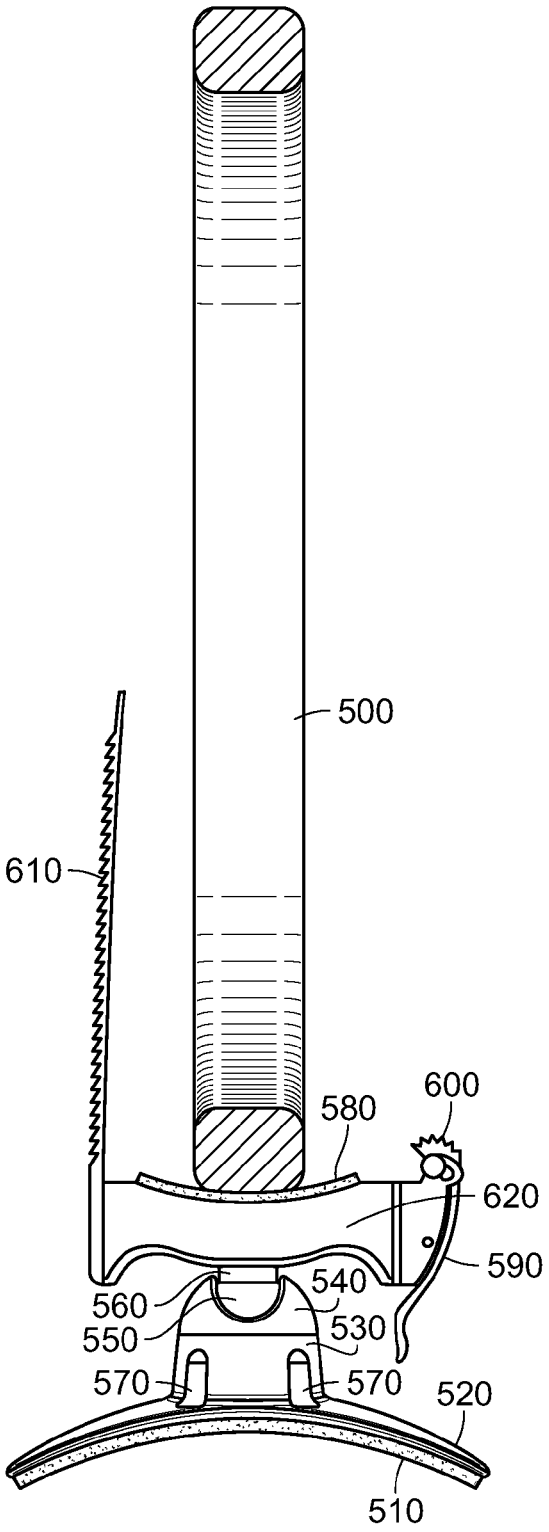
FIG. 8 is a side view of an alternative embodiment of the present invention attached to the handle of a child carrier.
Figure 9:
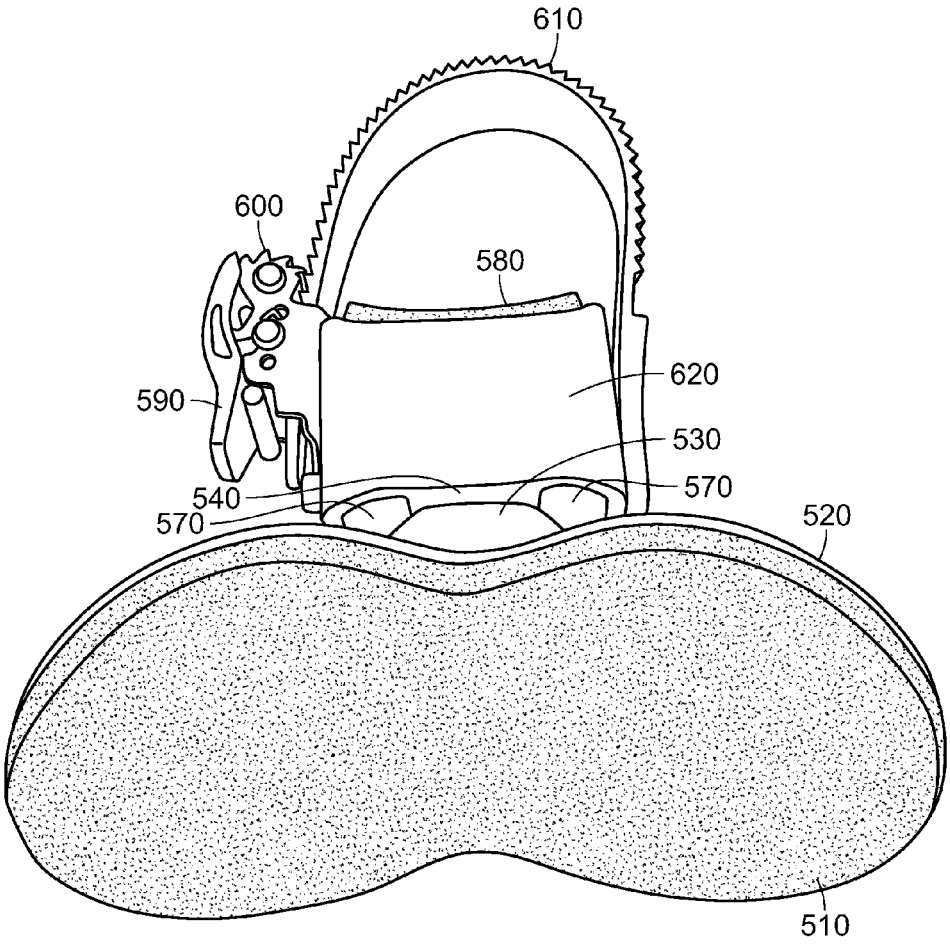
FIG. 9 is a front perspective view of the embodiment of the present invention from FIG. 8.
Figure 10:
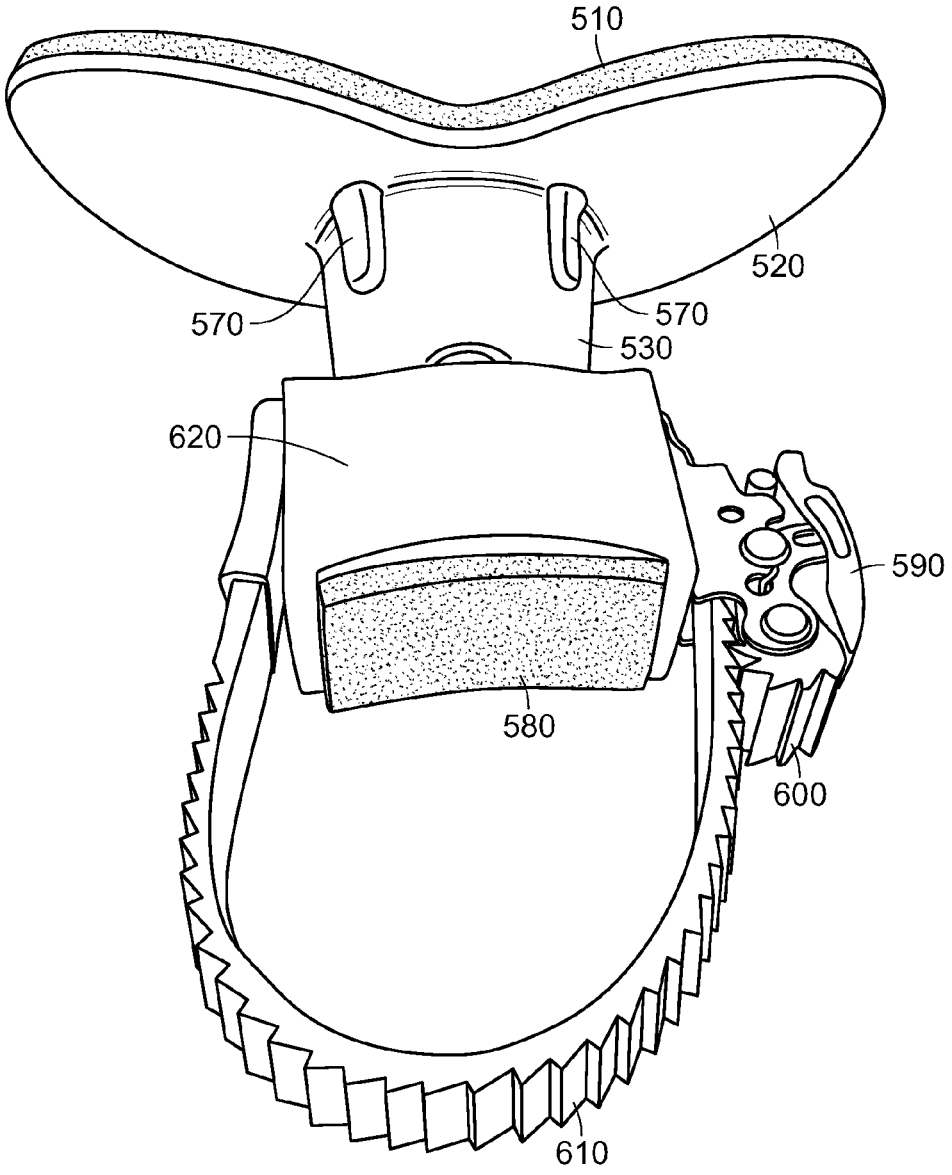
FIG. 10 is a rear perspective view of the embodiment of the present invention from FIG. 8.

In an alternative embodiment of the present invention, shown in FIGS. 8-10, The base 620 is placed against the handle 500 of any infant carrier. The ladder strap 610 which has "teeth" or "steps" integrated into it's design, is connected to the base 620 and wrapped around the inside of the handle 500. The end of the strap 610 is then threaded or inserted into the receiving end of the ratcheting buckle 600. The strap is pulled through the buckle 600 to take up any slack. With the device in place on the carrier, and the strap 610 threaded through the buckle 600, micro adjustments to tighten and secure the device to the carrier can be made by pulling up on the ratcheting buckles handle 590 singularly or multiple times to advance the strap through the buckle tighter and tighter by ratcheting on the teeth of the ladder strap.

The first base 620 is attached to the rigid body contour 520 via a second base 530. The second base 530 is attached to the rigid body contour 520 via attachment points 570. The layer of cushioning material 510 abuts the rigid body contour 520. The cushioning material 510 may be made from a foam material covered in a durable material such as PVC, Neoprene or other suitable cushioned material. The rigid body contour 520 is contoured such that the bumper attachment can rest comfortably against the body when in use, typically resting against a thigh or hip. The bumper attachment is held in place on a handle of a child carrier using a locking mechanism and a handle placement guide.

Figure 7:
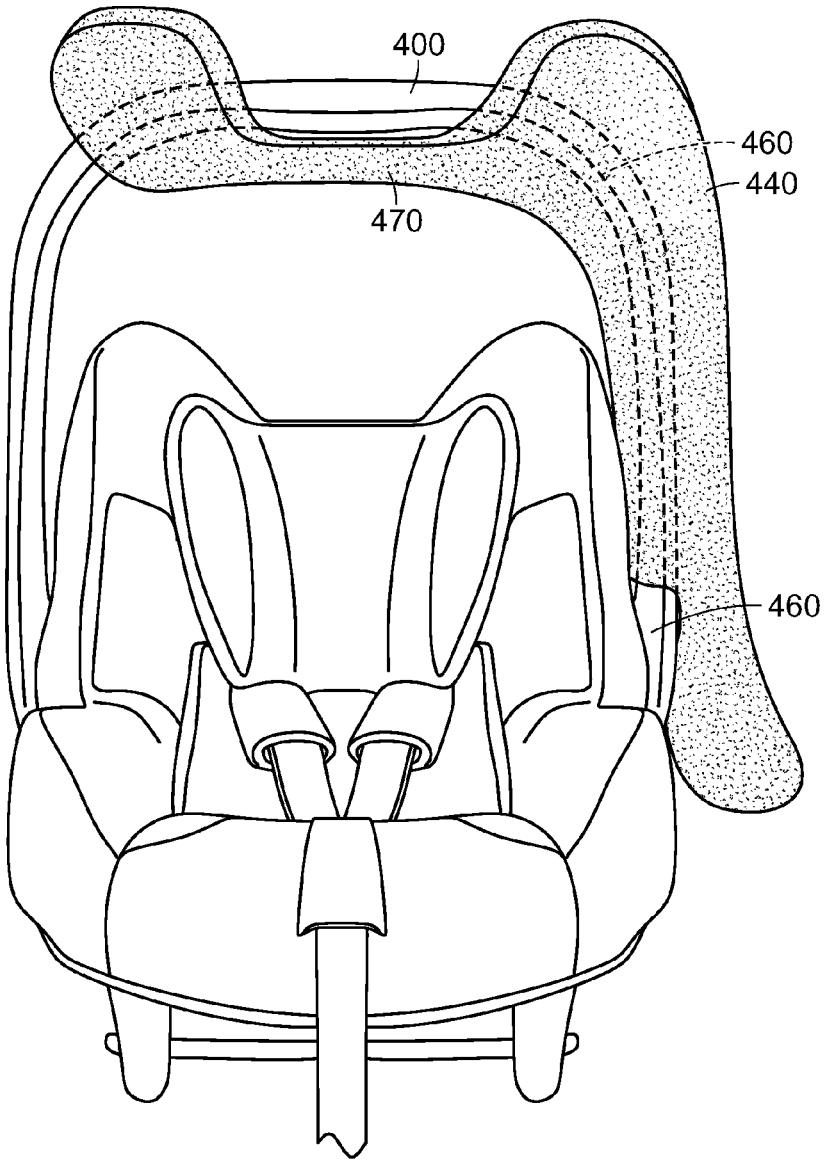
FIG. 7 is a front view of an alternative embodiment of the present invention.

In an alternative embodiment of the present invention as shown in FIG. 7, the bumper attachment is generally comprised of a locking mechanism, a handle placement guide 470, a rigid body contour 440, and a layer of cushioning material that either comprises the rigid body contour 440 or covers the rigid body contour 440. The locking mechanism locks the handle 460 of a child carrier into the handle placement guide 470, thereby positioning the layer of cushioning material that abuts the rigid body contour 440 against the body of the user.

In one embodiment of the present invention, the locking mechanism is accomplished such that the rigid body contour 440 may have handle placement guide 460 comprising an opening on one side wherein the transverse width of the opening that fits around the handle 460 is slightly smaller than the diameter of the handle 460, wherein the opening can be forcibly widened to wrap around the handle 460 and then allowed to retract to its original diameter such that the rigid body contour fits the object in a "press fit" manner. Alternatively, the transverse width of the opening that fits around the handle 460 may be slightly wider than the diameter of the handle 460, wherein the opening may be closed around the handle using wrapping, cinching, a hook and loop fastener, such as Velcro®, zippers or straps.

The invention may further comprise an outer covering can be made of a material that encloses the padded form of the design. The cushioning material can also be made of a self sealing or coating material creating it's own surface quality and texture.

The rigid body contour 440 covers the child carrier handle 460 from the top of the handle/arm all the way down the side of the handle and completely cover the joint or attachment area where the handle is attached to the bucket or child compartment portion of the child carrier. The top portion of the bumper attachment may have a "cut-out" design that allows the user access to the carrier handle 460.

The portion of the bumper attachment that covers the joint or attachment point to the bucket of the carrier still provides access to the release button for the handle assembly.

The bumper attachment can be manufactured as one continuous design that runs from top of the handle to beyond the joint/connection. Alternatively, the bumper attachment can be made in separate pieces that attach to the infant carrier in the same way.

The Locking Mechanism

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A bumper attachment device for supporting a load on a handle of a child carrier during transport by a user, the device comprising:

a. a portion shaped to receive the handle of the child carrier comprising:

i. a base plate with opposing left and right ends;

ii. an upper plate with opposing left and right ends; and iii. a guide hole b. a least one locking mechanism;

c. a rigid body contour; and d. a layer of cushioning material wherein the at least one locking mechanism secures the base plate to the upper plate at corresponding opposing ends such that the handle of the carrier passes through the guide hole;

wherein the locking mechanism locks the handle of the child carrier through the portion shaped to receive the handle; and wherein the layer of cushioning material abuts the rigid body contour and is positioned between the user and the rigid body contour.

2. The device of claim 1 wherein the locking mechanism comprises:

a. a plurality of screws;

b. a plurality of wing nuts; and c. a plurality of washers wherein the screws, washer and wing nuts secure the base plate to the upper plate at opposing ends.

3. The device of claim 1 wherein the rigid body contour is constructed from a material that is a rigid plastic material.

4. The device of claim 1 wherein the base plate is constructed from a material that is a rigid plastic material.

5. The device of claim 1 wherein the upper plate material is a rigid plastic material.

6. The device of claim 1 wherein the cushioning material is a foam material.

7. A bumper attachment device for supporting a load on a handle of a child carrier during transport by a user, the device comprising:

a. a portion shaped to receive the handle of the child carrier comprising:

i. a first half of a clamp with opposing right and left ends;

ii. a second half of a clamp with opposing right and left ends; and iii. a guide hole b. at least one locking mechanism;

c. a rigid body contour; and d. a first layer of cushioning material;

wherein the at least one locking mechanism secures the first half of the clamp to the second half of the clamp at corresponding opposing ends such that the handle of the carrier passes through the guide hole;

wherein the locking mechanism locks the handle of the child carrier through the portion shaped to receive the handle; and wherein the layer of cushioning material abuts the rigid body contour and is positioned between the user and the rigid body contour.

8. The device of claim 7 wherein the locking mechanism comprises:

a. a plurality of self-tightening screws; and b. a handle wherein the self-tightening screws are aligned at the opposing ends of the first and second half of the clamp and are tightened simultaneously and locked into place using the handle.

9. The device of claim 7 wherein the rigid body contour is constructed from a material that is a rigid plastic material.

10. The device of claim 7 wherein the first half of the clamp is constructed from a material that is a rigid plastic material.

11. The device of claim 10 further comprising a second layer of cushioning material wherein a side of the first half of the clamp abuts the handle and wherein the side is lined with said second layer of cushioning material.

12. The device of claim 7 wherein the second half of the clamp is constructed from a material that is a rigid plastic material.

13. The device of claim 12 further comprising a third layer of cushioning material wherein a side of the second half of the clamp abuts the handle and wherein the side is lined with said third layer of cushioning material.

14. The device of claim 7 wherein the first layer of cushioning material is a foam material.

15. A bumper attachment device for supporting a load on a handle of a child carrier during transport by a user, the device comprising:

a. a portion shaped to receive the handle of the child carrier comprising:

i. a base with opposing right and left ends;

ii. a ladder strap with opposing right and left ends;

iii. a ratcheting buckle; and iv. a guide hole b. a rigid body contour; and c. a first layer of cushioning material;

wherein the ratcheting buckle secures the ladder strap to the base at corresponding opposing ends such that the handle of the carrier passes through the guide hole;

wherein the ratcheting buckle locks the handle of the child carrier through the portion shaped to receive the handle; and wherein the layer of cushioning material abuts the rigid body contour and is positioned between the user and the rigid body contour.

16. A bumper attachment device for supporting a load on the handle of a child carrier during transport by a user, the device comprising:

a. a portion shaped to receive the handle of the child carrier comprising;

i. a rigid body contour;

ii. a handle placement guide;

b. at least one locking mechanism; and c. a layer of cushioning material wherein the at least one locking mechanism secures the rigid body contour around the handle such that the handle of the carrier passes through the guide hole;

wherein the locking mechanism locks the handle of the child carrier through the portion shaped to receive the handle; and wherein the layer of cushioning material abuts the rigid body contour and is positioned between the user and the rigid body contour.

17. The device of claim 16 wherein the handle placement guide comprises an opening on one side of the rigid body contour with a transverse width of the opening that fits around the handle that is slightly smaller than a diameter of the handle, wherein the opening is forcibly widened to wrap around the handle and then allowed to retract such that the rigid body contour fits the handle in a "press fit" manner.

18. The device of claim 16 wherein the handle placement guide comprises an opening on one side of the rigid body contour with a transverse width of the opening that fits around the handle that is slightly wider than a diameter of the handle.

19. The device of claim 18 wherein the opening is closed around the handle by wrapping, cinching, zipping, strapping or securing with hook and loop fastener.

20. The device of claim 16 further comprising an outer covering wherein the outer covering encloses the rigid body contour.

* * * * *